US012404629B2

(12) United States Patent
Stewart et al.

(10) Patent No.: US 12,404,629 B2
(45) **Date of Patent: *Sep. 2, 2025**

(54) RESIN FOR USE IN SETTING A CREASE IN A GARMENT

(71) Applicant: Supercrease Limited, Leeds (GB)

(72) Inventors: Paul Stewart, Leeds (GB); Daniel Houlbrook, Leeds (GB)

(73) Assignee: Supercrease Limited, Leeds (GB)

( * ) Notice: Subject to any disclaimer, the term of this patent is extended or adjusted under 35 U.S.C. 154(b) by 310 days.

This patent is subject to a terminal disclaimer.

(21) Appl. No.: 17/791,662

(22) PCT Filed: Jan. 13, 2021

(86) PCT No.: PCT/GB2021/050070

§ 371 (c)(1),
(2) Date: Jul. 8, 2022

(87) PCT Pub. No.: WO2021/144565

PCT Pub. Date: Jul. 22, 2021

(65) Prior Publication Data

US 2023/0030532 A1 Feb. 2, 2023

(30) Foreign Application Priority Data

Jan. 15, 2020 (GB) ..... 2000594

(51) Int. Cl.

| | |
|---|---|
| ***D06M 15/643*** | (2006.01) |
| ***A41D 1/10*** | (2006.01) |
| ***D06J 1/12*** | (2006.01) |

(52) U.S. Cl.
CPC ..... *D06M 15/643* (2013.01); *A41D 1/10* (2013.01); *D06J 1/12* (2013.01)

(58) Field of Classification Search
CPC ..... D06J 1/12; A41D 1/10; D06M 15/643
See application file for complete search history.

(56) References Cited

U.S. PATENT DOCUMENTS

| | | | | |
|---|---|---|---|---|
| 3,531,806 | A | 10/1970 | Shore | |
| 3,778,226 | A | 12/1973 | Kissa | |
| 4,778,299 | A * | 10/1988 | Coulter | A41D 1/10 118/710 |
| 11,583,889 | B2 * | 2/2023 | Houlbrook | B05C 17/00553 |
| 2012/0164335 | A1 | 6/2012 | Maliverney | |

(Continued)

FOREIGN PATENT DOCUMENTS

| | | | |
|---|---|---|---|
| CN | 104178006 | A | 12/2014 |
| GB | 1189501 | A | 4/1970 |

(Continued)

*Primary Examiner* — Shaun R Hurley
(74) *Attorney, Agent, or Firm* — GableGotwals

(57) ABSTRACT

A resin material of a type which can be applied to a garment crease line in a fluid condition and once exposed to a suitable environment, will then cure so as to harden and adhere along the crease line. The resin is free from tin or any organotin components while still maintaining the ability to cure and be effective. The resin, once cured, assists in prolonging the form of the crease in the garment. The resin material may be applied at the time of preparation of the new garment or, may, be applied after the garment has been washed.

13 Claims, 2 Drawing Sheets

(56) References Cited

U.S. PATENT DOCUMENTS

Figure 1A:
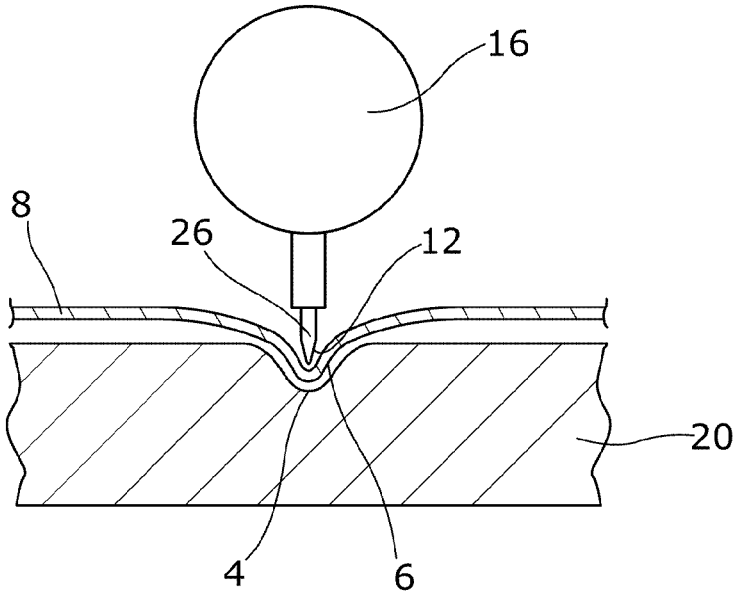

| | | | | |
|---|---|---|---|---|
| 2014/0275342 | A1* | 9/2014 | Guo | C08G 59/1438 523/400 |
| 2016/0024258 | A1 | 1/2016 | Pichl et al. | |
| 2017/0044338 | A1 | 2/2017 | Feder et al. | |
| 2018/0282940 | A1* | 10/2018 | Houlbrook | D06B 11/0073 |
| 2023/0371619 | A1* | 11/2023 | Stewart | D06M 23/16 |

FOREIGN PATENT DOCUMENTS

| | | | |
|---|---|---|---|
| JP | 2006225478 | A | 8/2006 |
| WO | 03033812 | A1 | 4/2003 |
| WO | 2018220377 | A1 | 12/2018 |
| WO | 2019193345 | A1 | 10/2019 |

* cited by examiner

RESIN FOR USE IN SETTING A CREASE IN A GARMENT

CROSS-REFERENCE TO RELATED APPLICATIONS

This United States application is the National Phase of PCT Application No. PCT/GB2021/050070 filed 13 Jan. 2021, which claims priority to British Patent Application No. 2000594.8 filed 15 Jan. 2020, each of which is incorporated herein by reference.

The invention to which this application relates is a resin which is provided for use to set a crease in a garment into which the resin is applied. The crease typically extends along the length of a trouser leg or a shirt sleeve but can be provided at any required location on the garment and it will be appreciated that for each garment, for example a pair of trousers, there will be a number of crease lines each of which receives the line of resin therealong.

The resin is initially provided in a fluid condition and held in a reservoir, in one example in a cartridge from which the resin is dispensed in a controlled manner as a line or ribbon of the fluid resin, via an exit aperture.

In the cartridge or other dispensing means the conventional resin, is provided so that once applied to the crease, the same starts to cure and harden upon exposure to atmospheric conditions and therefore forms a relatively hard solid ribbon of resin along the crease line and this has the effect of maintaining the crease line in the garment for a longer period of time than would be the case if the resin had not been applied thereto.

The resin is applied on the internal surface of the garment so that when the garment is worn, once the resin has hardened, the resin is not visible externally of the garment whilst the crease line in the garment is maintained.

This method, and the apparatus for applying the said resin, has been used for a considerable period of time and with significant commercial success worldwide.

However, it is found that there is an increasing resistance both from legislators and commercial users of the resin, to the use of which includes, as the curing component, tin. It is felt that the use of tin, or organo-tin or other tin derivatives in the resin, and the use of the resin in garments which are worn by persons, represents a risk of health problems to, primarily, the operators who are applying the resin material to the garments but also, potentially, to the end user. This is as a result of research which indicates that tin, in an isolated condition and without use in combination with other components, could possibly be carcinogenic.

Although, at present, there is no specific restriction on the use of the conventional resin material on the crease lines, the applicant has realised that there is a potential problem and therefore an aim of the present invention is to provide a resin material which is sufficiently fluid so that during the application process of the resin, the resin can be applied, preferably using conventional application apparatus and, secondly, the resin, once applied, will harden to a sufficient extent so as to allow the benefit of maintaining the crease in the garment for an extended period of time, and at least to the same extent as currently achieved, or preferably, to an increased extent, is provided.

A further aim is to provide the resin in a form which allows the same, once applied, to be effectively invisible and have no detrimental effect on the appearance of the garment and furthermore to ensure that the resin is retained in a condition once applied to the garment so that it does not become easily displaced or cracked.

In a first aspect of the invention, there is provided a resin for application to a crease line of a garment to have the effect of assisting in the retention of the crease line in the garment for a prolonged period of time, said resin provided to be usable in a first form during application onto and along the crease line when the same is in a fluid condition and, once applied along the crease line, change to a second form by curing and as a result of which, the resin hardens and attached in position along the said crease line and wherein the said curing agent is a tin and/or organo-tin free composition.

The provision of a resin which is tin free then any potential health risk due to the presence of tin is avoided, both at the time of preparation and filling of the cartridges, the dispensing of the resin onto the garment crease line and also during the wearing of the garment with the resin applied thereto.

In one embodiment, the resin includes a curing agent in the form of an acetate, and in one embodiment a crosslinking acetate.

In another embodiment, the resin includes a curing agent in the form of bismuth zinc.

In one embodiment the resin includes amorphous silicate hydrate, methylsilanetriyl-triacetate, diacetoxydi-tert-butoxysilane, hexanoic acid, dodecamethyl cyclohexasiloxane, acetic acid and octamethylcyclotetrasiloxane.

In one embodiment the amorphous silicate hydrate is replaced with bismuth tris(2-ethylhexanoate).

In one embodiment the resin includes triacetoxyethylsilane, octamethyl-cyclotetrasiloxane, Polybutylene terephthalate (PBT) and/or substances including dodecamethylcyclohexasilosane, and decamethylcyclopentasiloxane, also sometimes referred to as vRVB substances.

In whichever embodiment, the curing effect of the curing agent and hence the hardening of the resin occurs once the resin has been applied onto the garment.

Typically, the curing occurs as a result of the exposure of the resin to the surrounding environment and, typically, as a result of exposure to moisture in the environment in which the resin is applied. However in another embodiment curing may occur, or is encouraged, by mixing together of curing agent components and/or exposure to a specific property such as heat or Ultra Violet light.

In one embodiment the resin is free from any tin, organo-tin compounds and/or tin derivatives.

In a further aspect of the invention there is provided a method of applying a resin material to a crease line of a garment so as to assist in prolonging the retention of the crease line, said method comprising the steps of providing a supply of a fluid resin material to a dispensing means having an exit aperture for the controlled movement of the fluid resin therethrough and guiding the relative movement of the exit aperture and the crease line such that the fluid resin is applied from the exit aperture along the crease line as a ribbon or line of fluid resin, curing said resin to harden the same and attach the same along the crease line and wherein the resin is tin and/or organo-tin free.

In one embodiment the curing agent which causes the resin to cure is a crosslinking acetate and/or bismuth zinc.

In a further aspect of the invention there is provided a resin material which changes from a first, fluid, form to a second, substantially solid form, said change achieved as a result of the activation of a curing agent and wherein the curing agent is either of a crosslinking acetate and/or bismuth zinc.

Typically, the activation of the curing agent occurs when the resin in which the curing agent is included is exposed to the ambient environment having been dispensed onto a garment crease line.

In one embodiment the activation occurs during and/or after the resin material has been applied to a crease line of a garment and the resin is absorbed at least partially into the garment and hardens.

In a further aspect of the invention there is provided a cartridge containing a resin material as defined herein and having an exit aperture through which said resin material is dispensed in a fluid form.

Typically the cartridge includes a reservoir therein in which a quantity of the resin is located and a movement means which moves along the reservoir in a direction towards an exit aperture when a movement force, such as a pressurised gas such as air, is applied so as to move the resin towards and through the exit aperture to be dispensed.

Typically the quantity of resin, size of reservoir and/or size of cartridge is selected with respect to a particular use or number of uses required from each cartridge. In one embodiment the said cartridge is refillable.

In one embodiment the apparatus for the application of the resin along a crease line of the garment includes a reservoir in which the resin is held in a fluid condition, a supply means for the resin to be transferred to application means including an exit aperture from which the fluid resin is applied, and guide means to guide the relative movement between the application means exit aperture and the crease line so as to apply a line or ribbon along the base of the crease line.

In one embodiment the reservoir and exit aperture and guide means are provided as an integral part of a cartridge which contains a predetermined quantity of said resin and supply means in the form of a piston which is located in the reservoir and moves under pressure from a pressurised gas such as air to move along the reservoir and exert a movement force on the resin towards the exit aperture.

In another embodiment the reservoir is a drum or other container separate to the application means and is connected thereto via a pipe or tube so as to pump the resin towards the application means exit aperture. In this embodiment the application means includes a body portion on which the exit aperture and guide means may be located.

In one embodiment the guide means include a base or table in which one or more grooves are formed and which receives therealong the crease line of the garment along which the resin is applied and thereby retains the crease line in position as the resin is applied therealong and as the resin starts to cure. Typically the resin is applied to the crease line on the inner surface of the garment.

In a further aspect of the invention there is provided a garment including at least one crease line along which a resin material as herein defined is applied and cured to harden and assist in the retention of the crease line form.

Figure 1B:
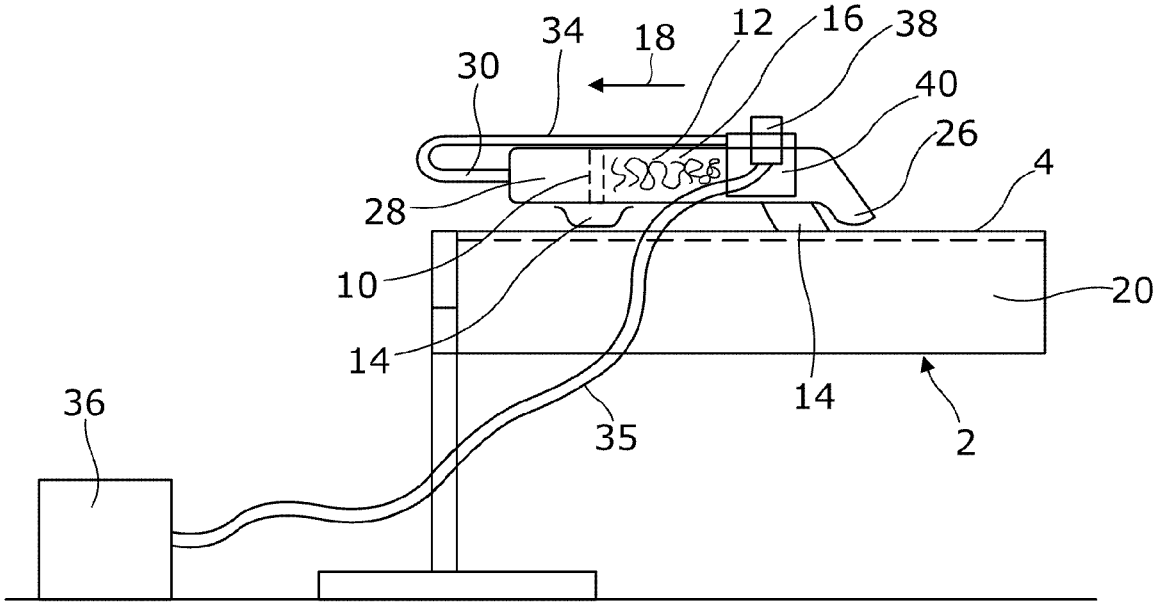
Figure 2:
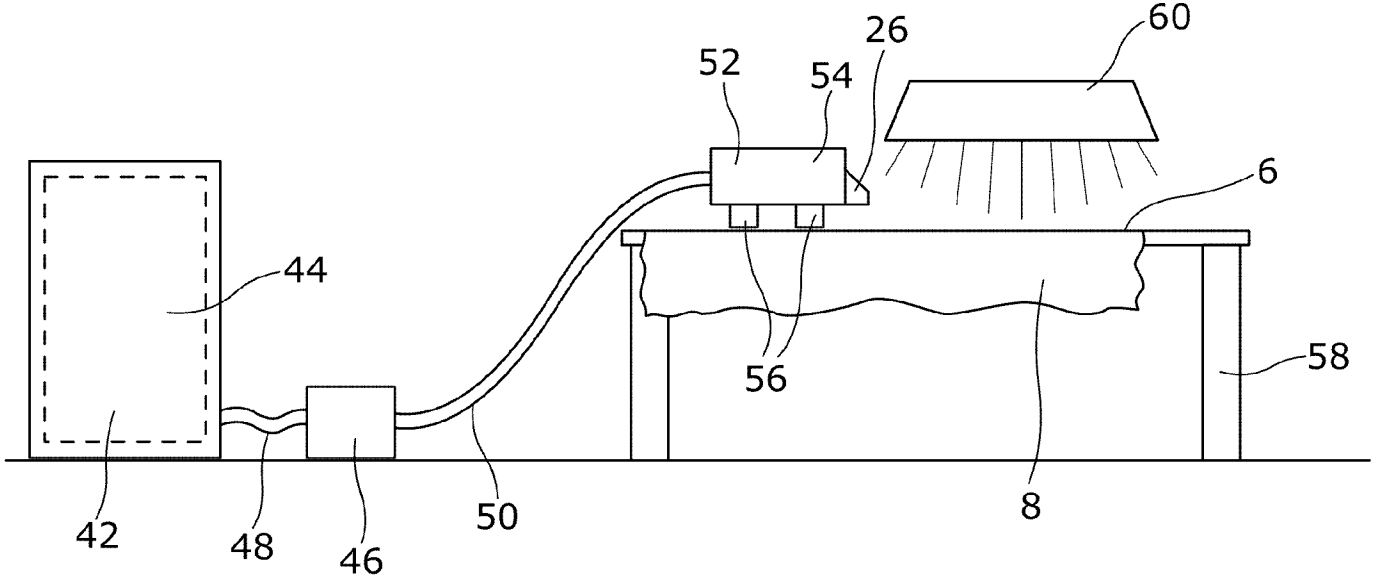

Specific embodiments of the invention are now described with reference to the accompanying drawings wherein:

FIG. 1*a* illustrates an end view of apparatus used to apply the resin to a crease line of a garment;

FIG. 1*b* illustrates a front view of one embodiment of the apparatus used for applying a resin material to harden along a crease line of a garment; and FIG. 2 illustrates a further embodiment of apparatus for use to apply the resin in accordance with the invention.

Referring to the FIGS. 1*a* and *b*, there is illustrated apparatus 2 for use in the application of a fluid resin material 12 to a crease line 6 of a garment in order to increase the permanence of the crease 6 in the garment 8 and thereby maintaining the appearance of the garment over a longer period of time. Typically, the resin material 12 will be added at the time of manufacture of the garment and/or after the cleaning of the garment and typically, the application of the resin is applied on a commercial basis rather than being applied by the person who has purchased the garment.

In the embodiment shown, the apparatus 2 which is used to apply the resin includes a source of pressured fluid such as air and an air pump 36 is connected to a control means 38 which can be provided, as shown in this embodiment, as a hand operated switch located on mounting means 40. The air is supplied to an end 30 of a cartridge 16 via an air tube 34 and is connected to the air pump 36 via air tube 35. The size and design of the cartridge may change to suit particular uses. The air pump can be switched on and off and hence control of the supply of the pressurised air is achieved via the switch 38 which is connected to the tubes 34 and 35. The air, which is pressurised and exits the air pump, is passed to the entrance aperture 30 of the cartridge 16. The cartridge 16 includes a body 28 in which there is defined a reservoir and in which there is provided a piston 10 and, intermediate the piston and the exit aperture 26 of the cartridge, there is provided a quantity of the resin material 12 in a fluid condition. The cartridge body mounting means 40 include the finger switch 38 for the control of the air pump and which can be gripped by the user when moving the cartridge.

The cartridge, in this example, includes guide means 14 at spaced intervals along the length of the cartridge body as shown and these lie along and contact with the crease line and lie along the same axis as the elongate exit aperture 26 of the cartridge. The guide means are provided to be received and pass along the internal surface of the crease line of the garment 8 and thereby guide the cartridge as it is moved along the crease line. The crease line, in turn, lies in a V-shaped or gull-wing shaped groove 4 which is provided on a support surface or arm 20 and this acts to maintain the crease line along the required linear path and the cartridge is moved along the internal surface of the garment in the direction of arrow 18 and as the relative movement between the garment and the cartridge occurs, so the operation of the air pump operation moves the piston 10 along the cartridge reservoir to move the resin material 12 towards and through the exit aperture 26 to be dispensed as a line or ribbon of the resin material along the crease 6. It should be appreciated that in other forms of the apparatus the resin may be supplied from a reservoir of the resin to a dispensing aperture 26 from which the resin is applied to the crease line and in this embodiment there is no need to provide the cartridge.

In FIG. 2 there is illustrated an alternative embodiment of the apparatus and for ease of reference the same reference numerals are used for the same features as the embodiment shown in FIGS. 1*a* and *b*. The application of the resin material is also applied in a similar manner to that shown in FIG. 1*a* but in this embodiment no cartridge is provided and instead a drum or container 42 which includes a reservoir 44 of resin material. The reservoir is connected via tubes 48, 50 and via a pump 46 to application means 52 which include a mounting means including a gripping portion 54 and skis or skids or wheels 56. The tube is connected to the exit aperture 26 and through the same to be dispensed along the crease 6 of the garment 8 as previously described with the crease and garment located on a groove and support table 58 or a similar support arm 20 to that shown in the embodiment of FIGS. 1*a* and *b*.

In either embodiment, when the resin is dispensed from the exit aperture, the resin is still in a fluid condition and therefore flows out of the aperture 26 and onto and along the crease line.

Once the resin material has been applied to, and typically has passed at least partially into the crease line, the exposure to the surrounding environment causes the curing agent within the resin to cure and harden on and attach to the crease line of the garment 8 and retain the form of the crease 6 and thereby ensures that if the resin material has been applied correctly to the base of the crease 6, the resin assists in maintaining the form of the crease in the garment for a longer period of time than would be the case if the resin had not been applied.

In accordance with the invention, the resin material 12, is provided with a curing agent which is either a crosslinking acetate or a bismuth zinc and neither of these curing agents require any further action to cure the same once the resin has been applied to the garment crease line. This is because the curing agent will react to exposure to the ambient environment and particularly the moisture in the environment, and cure and therefore no further equipment or apparatus is required to be used to cause the curing of the resin. However, in order to further encourage a relatively fast curing effect, or if the curing agent in the resin is changed, then it is possible that the apparatus will include apparatus for providing, for example, heat or creating infra-red or ultra-violet or other curing effects on the resin once it has been applied so as to cure or improve the curing of the resin. An example of the apparatus for achieving this is provided in FIG. 2 which illustrates a unit 60 positioned above the garment 8 at the location at which the resin will already have been applied and the unit can then emit a curing means such as heat or suitable light onto the resin line to cure the same.

Thus, in accordance with the invention there is provided a means of extending the length of a crease line in a garment using a resin material which is environmentally friendly and has reduced potential health impact as the curing agents used, and hence resin as a whole, is free from tin, organo-tin and any tin compounds and so concerns with regard to health and safety are overcome and avoided.

The invention claimed is:

1. A resin for application to a crease line of a garment to have the effect of assisting in the retention of the crease line in the garment for a prolonged period of time, said resin provided to be usable in a first form during application onto and along the crease line when the same is in a fluid condition and, once applied along the crease line, change to a second form by curing and as a result of which, the resin hardens and is attached in position with the fibers of the garment along the said crease line and wherein the said resin is a tin and organo-tin free composition and includes an acetate curing agent.

2. A resin according to claim 1 wherein the acetate is a crosslinking acetate.

3. A resin according to claim 1 wherein the resin includes a curing agent in the form of bismuth zinc.

4. A resin according to claim 1 wherein the resin includes any, or any combination of amorphous silicate hydrate, methylsilanetriyl-triacetate, diacetoxydi-tert-butoxysilane, hexanoic acid, dodecamethyl cyclohexasiloxane, acetic acid and/or octamethylcyclotetrasiloxane.

5. A resin according to claim 1 wherein the resin includes triacetoxyethylsilane, octamethyl-cyclotetrasiloxane, PBT and/or substances including dodecamethylcyclohexasilosane, and decamethylcyclopentasiloxane.

6. A resin according to claim 1 wherein the curing effect of the curing agent in the resin and hardening of the resin occurs after a period of time of exposure to moisture in the ambient environment in which the resin is applied onto the garment.

7. A resin according to claim 1 wherein the curing occurs or is encouraged by the mixing together of curing agent components and inclusion in the resin.

8. A resin according to claim 1 wherein the curing occurs or is encouraged by exposure to and/or application of a specific property to the resin when applied.

9. A resin according to claim 8 wherein the specific property is any, or any combination of, heat and/or ultra-violet light.

10. A resin according to claim 1 when the resin is free from any tin derivative materials.

11. A method of applying a resin material to a crease line of a garment so as to assist in prolonging the retention of the crease line, said method comprising the steps of providing a supply of a fluid resin material to a dispensing means having an exit aperture for the controlled movement of the fluid resin therethrough and guiding the relative movement of the exit aperture and the crease line such that the fluid resin is applied from the exit aperture along the crease line as a ribbon or line of fluid resin, curing said resin to harden the same and attach the same along the crease line and wherein the resin is a tin and organo-tin free resin composition and includes an acetate curing agent.

12. A cartridge containing a resin material as defined in claim 1 and having an exit aperture through which said resin material is dispensed in a fluid form.

13. A garment including at least one crease line along which a resin material as defined in claim 1 is applied and cured to harden and assist in the retention of the crease line form.

* * * * *